US006158808A

United States Patent [19]

Margolis et al.

[11] Patent Number: 6,158,808

[45] Date of Patent: Dec. 12, 2000

[54] FULLY ADJUSTABLE LOUNGE CHAIR

[76] Inventors: Meg Margolis, 327 'C' St., San Rafael, Calif. 94901; Kenneth Tarlow, 21 Golden Hind Passage, Corte Madera, Calif. 94925; Rhoda Colen, 334 Acadia La., San Rafael, Calif. 94903; August Colenbrander; Jeanné Colenbrander, both of 50 Meadowood Dr., Larkspur, Calif. 94939-1523

[21] Appl. No.: 09/263,534

[22] Filed: Mar. 5, 1999

[51] Int. Cl.[7] ..... A47C 1/02

[52] U.S. Cl. ..... 297/330; 297/337; 297/362.11; 297/362.14; 297/376; 297/411.38; 297/284.5; 297/423.33; 297/423.35

[58] Field of Search ..... 297/423.13, 423.26, 297/362.14, 362.12, 337, 330, 411.38, 411.25, 411.29, 284.5, 284.3, 284.1, 362.11, 376, 423.3, 423.31, 423.32, 423.33, 423.34, 423.35, 411.35, 397, 391, 284.4, 284.9

[56] References Cited

U.S. PATENT DOCUMENTS

| | | |
|---|---|---|
| 2,661,227 | 12/1953 | Murphy . |
| 3,132,897 | 5/1964 | Linden . |
| 4,691,964 | 9/1987 | Morgan . |
| 4,876,755 | 10/1989 | Parrish . |
| 5,507,562 | 4/1996 | Wieland . |
| 5,533,787 | 7/1996 | Xiang . |

*Primary Examiner*—Milton Nelson Jr.

[57] ABSTRACT

A fully adjustable lounge chair with an independently adjustable back support member, thigh support member and foot support member. A support pole for each of the support members attaches at its lower end to a horizontally disposed push bar. A rolling pinion gear is rigidly attached to each end of a shaft supported within the push bar so that the pinion gears reside at each end of the push bar. A pair of parallel rack type gears mate with the rolling pinion gears. A motorized screw type linear translation mechanism pivotally attached to each of the push bars causes the support members to raise and lower. "U" bracket type hinge members attach each support pole to the underside of each of the back support, thigh support and foot support members. A pair of shafts and associated pivotal hinge points attachs the back and thigh support members to a pair of vertically disposed support plates. A hinge point attaches the thigh support to the foot support so that there are no gaps between said support members regardless of the adjusted angle of the support members. A pair of cylindrical sockets located midway along the side rails of the back support are capable of pivotally holding arm support members. A pair of slidable and lockable channels allows the user to adjust the length of the thigh support member. A preferred embodiment includes a plurality of independent cushions including lumbar support, spine support, neck support, pelvic support and hip supports all capable of being removably attached and adjusted with respect to the back support member.

9 Claims, 5 Drawing Sheets

FULLY ADJUSTABLE LOUNGE CHAIR

BACKGROUND OF THE INVENTION

This invention relates generally to the field of chairs, and more particularly to a fully adjustable lounge chair.

Chairs and other means for supporting a sitting or reclining person have been in existence for thousands of years.

More recently adjustable lounge chairs have been developed that can support a person in a variety of positions such as "LazyBoy" recliners. Generally these recliners have a pivoting back support member and when the back is pushed rearward a calf and foot supporting member rises from a vertical position to a relatively horizontal position. Although these recliners do provide a degree of comfort, they are far from being ergonomic ally perfect with respect to the ideal support of the entire human body.

Furthermore, the current design of recliners does little to accommodate for different size body types. Finally, current recliners do not have independently adjustable support surfaces thereby limiting the angular relationship between the different support members.

SUMMARY OF THE INVENTION

The primary object of the invention is to provide a lounge chair that has an independently adjustable foot support, thigh support and back support.

Another object of the invention is to provide a lounge chair that has removably adjustable cushions including, spine support cushions, head and neck support cushions, lumbar support cushion, pelvic tilt cushion and hip support cushions.

Another object of the invention is to provide a pair of rotatable and raisable arm support members for ideal support of the arm and hand.

Another object of the invention is to provide a plurality of motorized linear translation devices to allow the user to automatically selectively adjust the angle of either the back, thigh and foot supports.

A further object of the invention is to provide a hinge mechanism attaching the foot support to the thigh support that does not cause a gap between the supports regardless of angle.

Yet another object of the invention is to provide a means for housing the adjustment mechanism in a low profile base portion thereby allowing the support members to appear to float in air. Another object of this invention is to provide a pair of slidable and lockable side channels to adjust the length of the thigh support member.

Other objects and advantages of the present invention will become apparent from the following descriptions, taken in connection with the accompanying drawings, wherein, by way of illustration and example, an embodiment of the present invention is disclosed.

A fully adjustable lounge chair comprising: an independently adjustable back support member, thigh support member and foot support member, a support pole for each said support member, a horizontally disposed push bar centrally attached to each said support pole, a rolling pinion gear rigidly attached to each end of a live shaft supported within each said push bar so that said pinion gears reside at each end of said push bar, a pair of horizontally disposed parallel rack type gears that mate with said rolling pinion gears, a motorized screw type linear translation mechanism pivotally attached to each of the said push bars, U bracket type hinge members attaching each said support pole to the underside of each of the said back support, thigh support and foot support members, a pair of shafts and associated pivotal hinge points attaching said back and thigh support members to a pair of vertically disposed support plates, a hinge point attaching the thigh support to the foot support so that there are no gaps between said support members regardless of the adjusted angle of said support members, a pair of cylindrical sockets located midway along the side rails of said back support, said sockets capable of pivotally holding arm support members. Slidable and lockable side channels allow the user to lengthen or shorten the thigh support member according to the users body size.

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
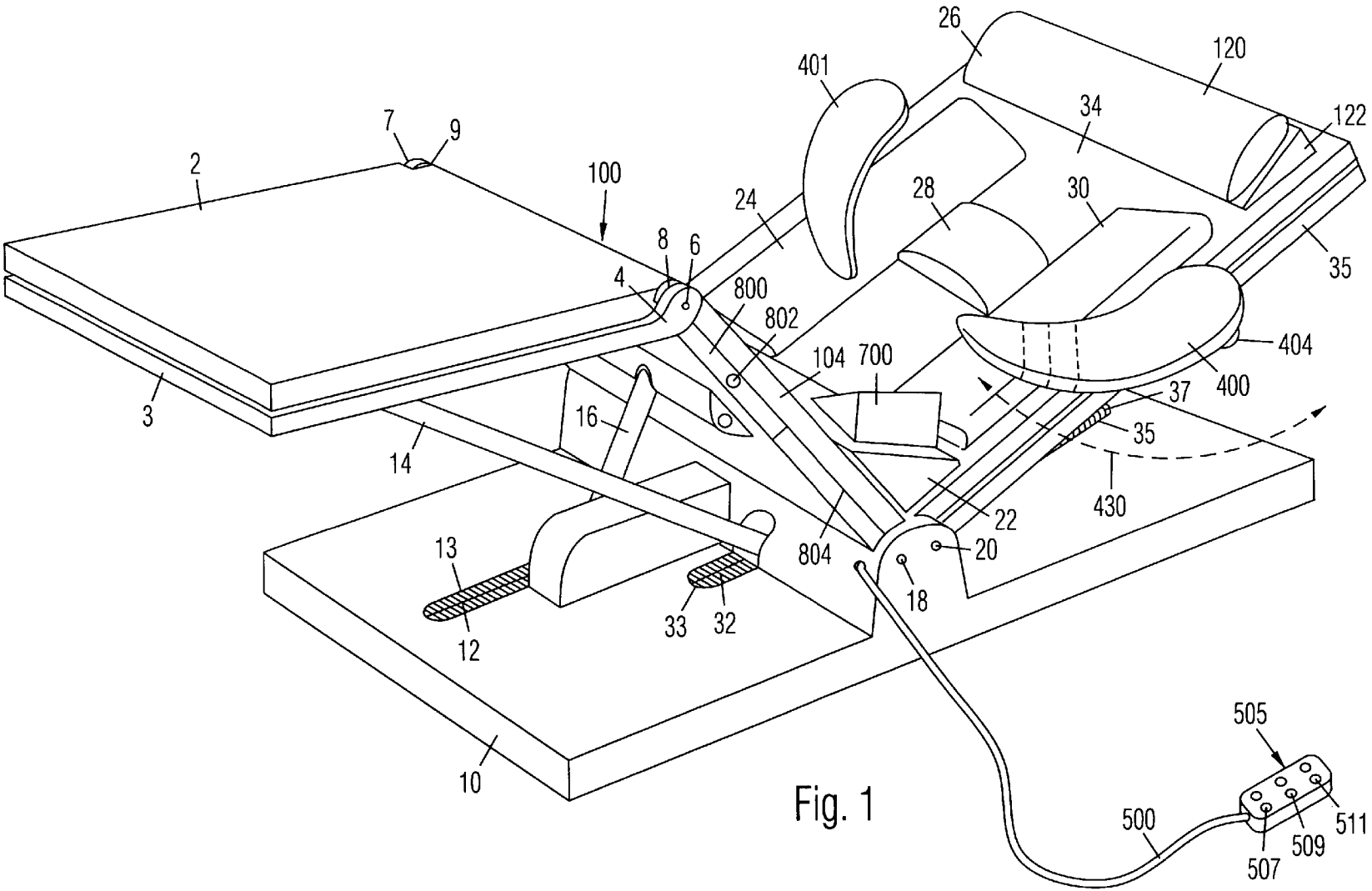
FIG. 1 is a perspective view of the lounge chair of the present invention.

Referring now to FIG. 1 we see a perspective view of the lounge chair 100 of the present invention. The three main support surfaces are the foot support 2, the thigh support 104 and the back support 34. The thigh support 104 and the back support 34 are pinned at their lower portion at pivot points 18,20. Foot support 2 is pivotally hinged at point 6,8 and 7,9 to thigh support 104. The pivot point 6,7 coincides with the center point of the two support cushions so that when the angle between the two cushions 2, 104 changes, there is no significant gap between the two chancels 800, 804 can be lengthened or shortened and then locked in place by tension knob 802 thereby allowing the user to adjust the length of the thigh support 104 according to the users hip to knee dimension. Arm supports 400, 401 are pivotally connected at cylindrical sockets 404, 405. Removable and adjustable cushions 30, 24 support the rib cage area of the user so that the pressure is reduced on the user's spine. Removable and adjustable lumbar support 28 supports the lumbar area. Removable and adjustable neck and head cushions 122, 120 can be located to support the users head and neck at a stress free angle. Cushion 122 is triangular in cross section and can be reversed if the user wants to tilt his or her head further back. Cushion 22 is a pelvic tilt cushion which causes the pelvis of the user to be in the most stress free position. Hip cradles 700,702 support the hips so that pressure is taken off the lower spine. The overall effect is that the spine of the user is relieved of excess pressure so that persons with spinal pain tend to feel relief from such pain. Switch box 505 is connected by wire 500 to a motor control junction box located within the base of the unit 100. Switch pair 511 controls the angle of the back support member 34. Switch set 509 controls the angle of the thigh support member 104. Switch set 507 controls the angle of the foot support member 2. Base plate 10 covers the linear translation mechanisms slots 13, 33, 35 allow support poles 14, 16, 72 to travel unimpeded. Brush members 12, 32, 37 cover the slot areas where the support poles are not residing.

Figure 2:
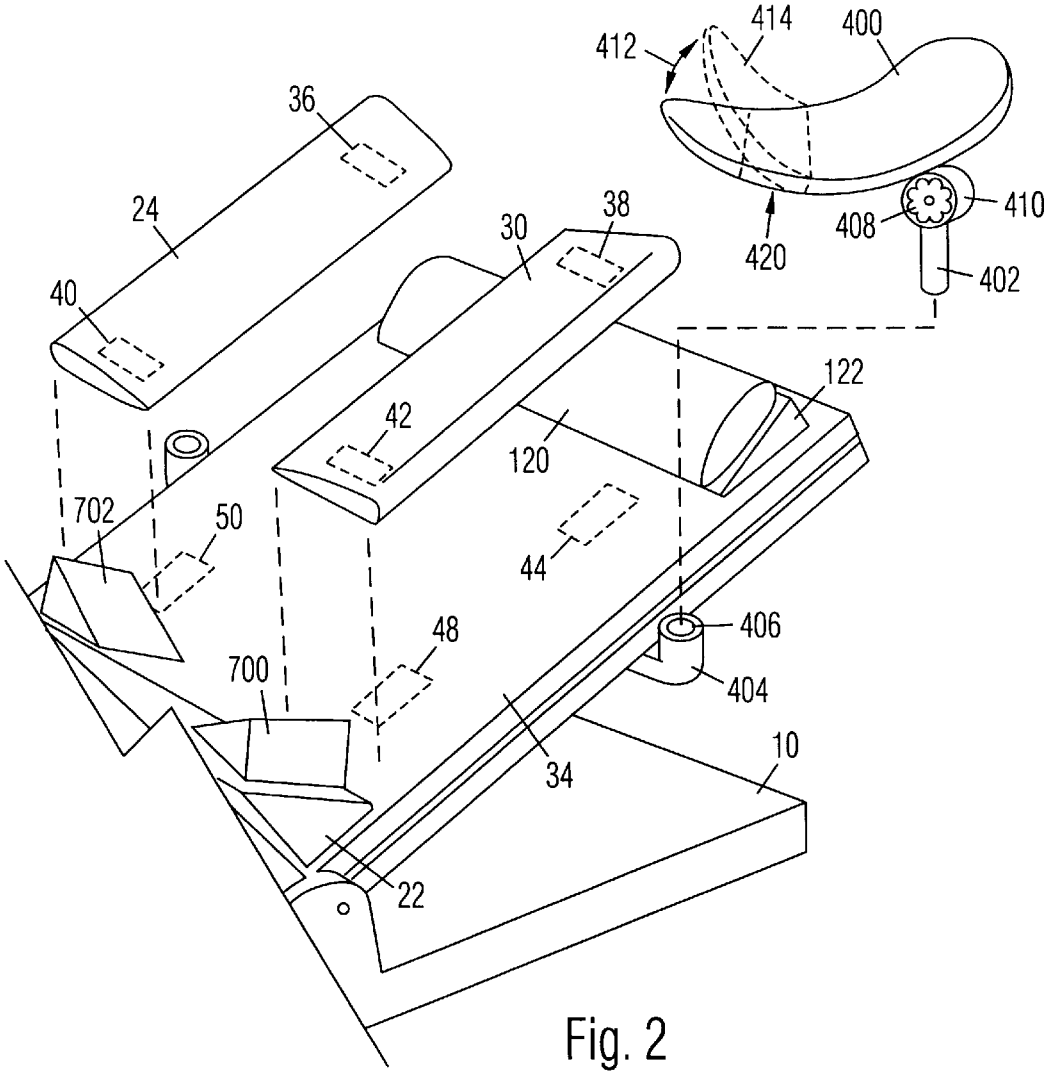
FIG. 2 is a partial exploded view of the present invention.

FIG. 2 shows a partial exploded view of the back support portion 34 and associated cushions 30,24 120,122 and arm rests 400. Flexible magnetic strips 44,48,50, are located on the underside of the upholstery cover of back support cushion 34. Metallic strips 42, 38, 40, 36 are located on the underside of cushions 30, 24 at a ninety degree angle to the magnetic strips 48, 44, 50 so that the user can position cushions 30, 24 closer together or further apart depending on body size and comfort preference. The cushions stay in place by magnetic attraction thereby eliminating the need for unsightly attaching means on the top surface of back support member 34. Of course, attachment means such as velcro or snaps can be used, however they would be detrimental to overall appearance. Neck support cushion 122 and lumbar support cushion 28 are held in place by similar means. Head support cushion 120 can be held onto neck cushion by velcro type fasteners or snaps or the like since that junction will not be seen under normal circumstances. The same is true for pelvic tilt cushion 22. Hip cradle cushions 700, 702 are simply placed on pelvic tilt cushion 22 so that can be easily moved closer together or further away by the user while in use. Arm support post 402 inserts into cup 406 so that the entire arm rest 400 can swivel. Adjustable joint 410 can be loosened by hand screw knob 408 and arm rest 400 can then be pivotally raised or lowered depending on the body size of the user. Hand screw knob 408 is then tightened. The forward portion of arm rest 400 is segmented so that the forward portion can be bent 42 in an upwards orientation 44 thereby allowing for the forearm and hand of the user to be supported yet also allowing for the arm support 400 to rest on the stomach portion of the user. Supporting the arms in this way takes pressure off the chest cavity of the user creating more of a feeling of suspension.

Figure 3:
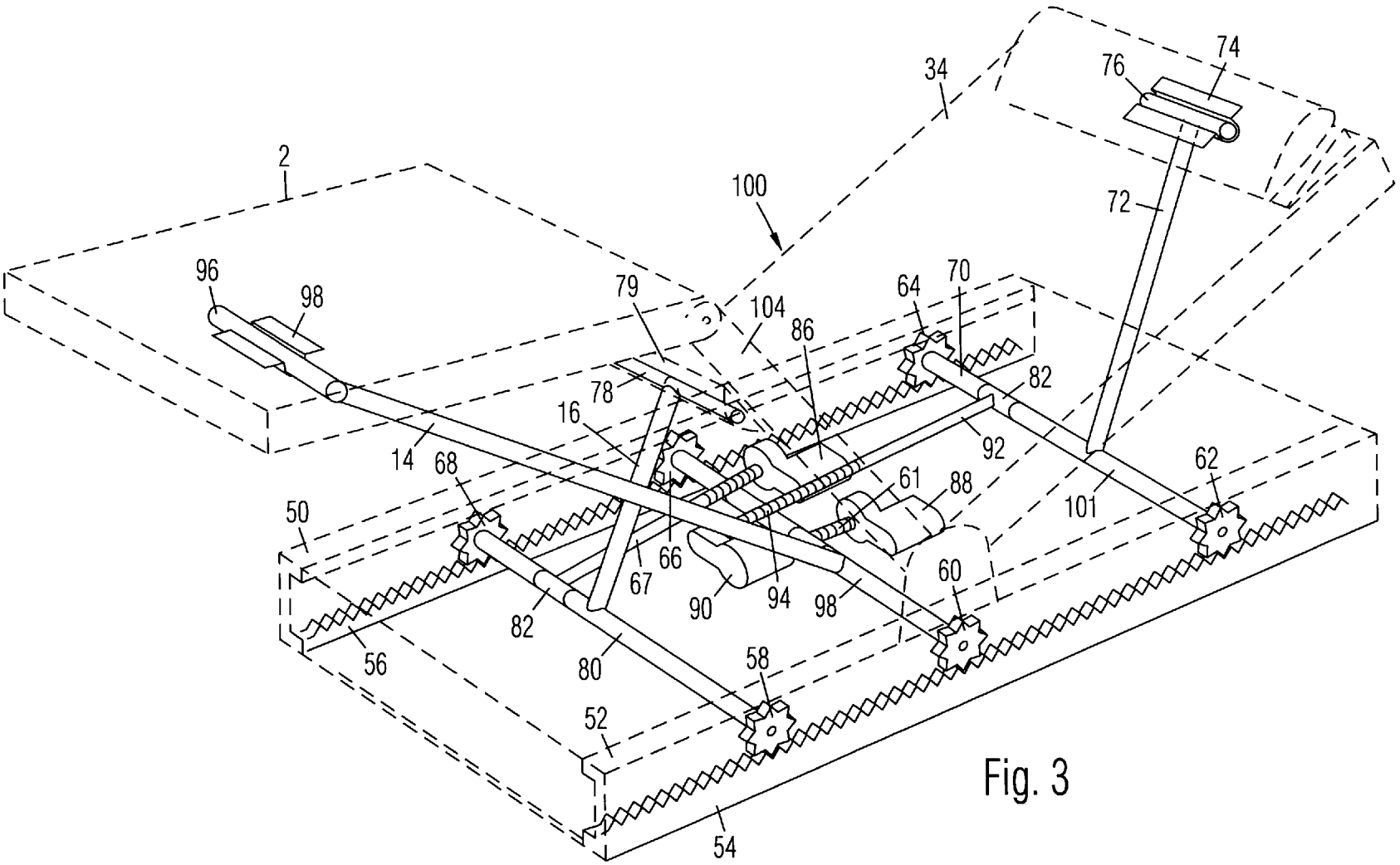
FIG. 3 is a phantom view of the adjustable support mechanism of the present invention.

FIG. 3 is a phantom perspective view of the lounge chair of the present invention 100. This view is useful in showing the mechanical construction of the body support angle changing means. Base channels 50, 52 each contain rack type gears 54, 56. Horizontal push bars 80, 90, 101 each have a live shaft within, supported by bearings. Each end of the each shaft is terminated by fixed pinion gears 58,60,62, 64,66,68 that mate in a rolling fashion with racks 54, 56. Because the pinion gear pairs are fixed with relation to each other, Each push bar 80, 98, 101 remains at a ninety degree angle with respect of the side channels 50, 52 thereby reducing the tendency of the support members 2, 104, 34 to rock from side to side. Push rods 16, 14, 72 are perpendicularly welded to horizontal push bars 80, 98, 101. At their opposite ends T shaped hinge members 96, 78, 76 rotatably couple with U brackets 98, 79, 76. Each horizontal push bar is centrally pushed and pulled by linear drive mechanisms 86, 88, 90 whose extendable or retractable nut shafts 67, 61, 92 are pivotally coupled to the push bars by fixedly attached push bar retaining sleeves 82, . Actuation of the linear translation motor assembly's 86, 88, 90 causes the horizontal push bars 80, 98, 101 to be pushed or pulled thereby causing support members 2, 104, 34 to change angle with respect to each other.

Figure 4:
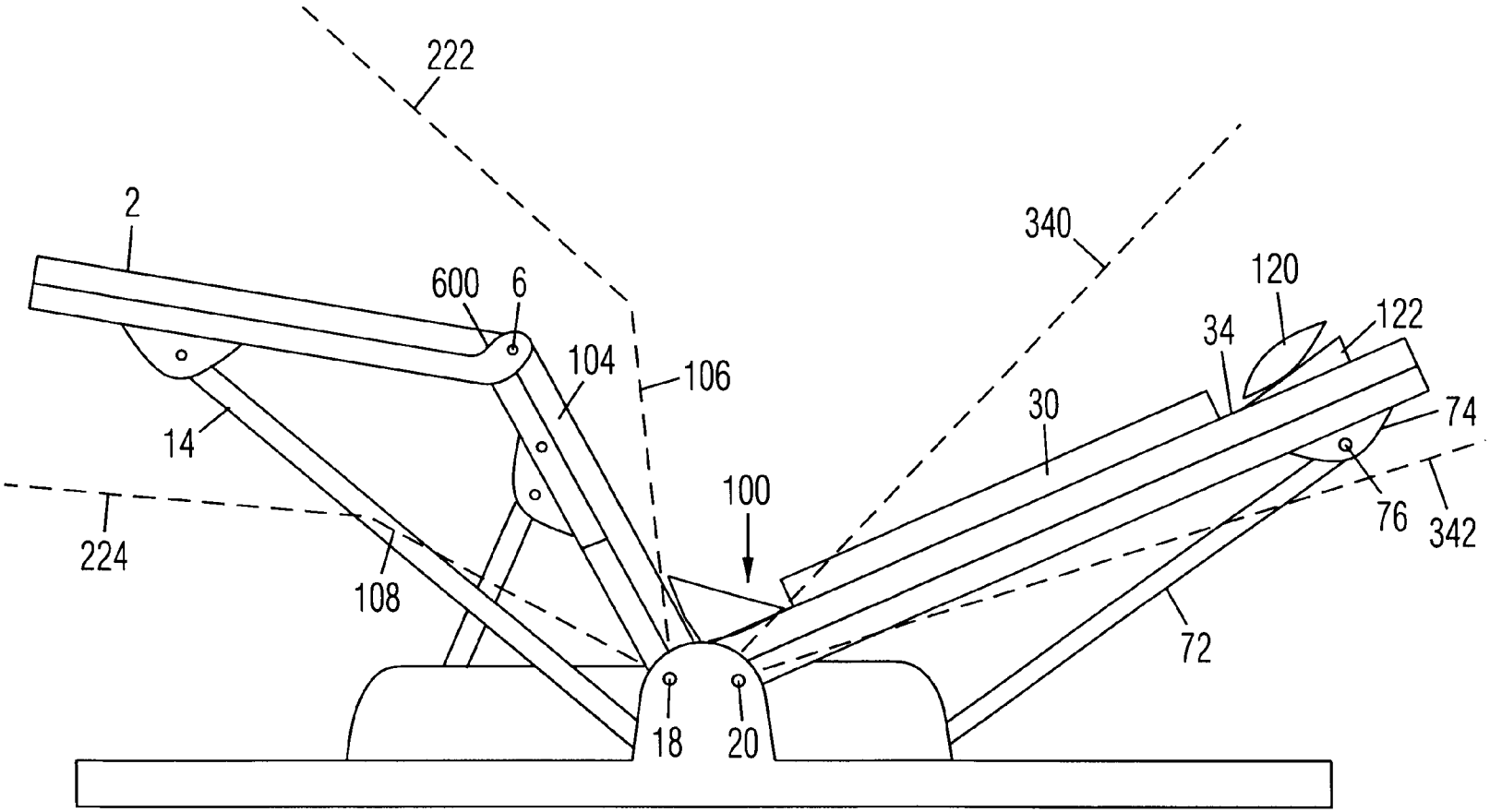
FIG. 4 is a side view of the present invention.

FIG. 4 shows a side view of the present invention 100. Dotted lines 224, 222 show degree of adjustability of foot support member 2. Dotted lines 106,108 show degree of adjustability of thigh support member 104. Dotted lines 340, 342 show degree of adjustability of back support member 34. Position indicated by dotted lines 224, 108, 340 is ideal for reading or watching TV. Position indicated by dotted lines 222, 106, 342 is ideal for relaxation and assisting blood flow to the heart since the user's legs are raised above his or her torso in this position. Dotted line 600 shows the meeting of cushion 104 with cushion 2. Because the two cushions are supported at pivot point 6 the concave portion of cushion 2 rotates about the convex portion of cushion 104 so that no mater what angle the cushions are to each other, there is no significant gap between the two thereby affording maximum support and comfort for the user. Since the linear translation mechanisms are located in the base 700 and the support members 2, 104, 34 are supported by only a single pole each, the dy bosupport members 2, 104, 34 appear to "float" in the air thereby reducing the perceived bulk of the chair 100 and thereby making it more attractive and suitable for home use.

Figure 5:
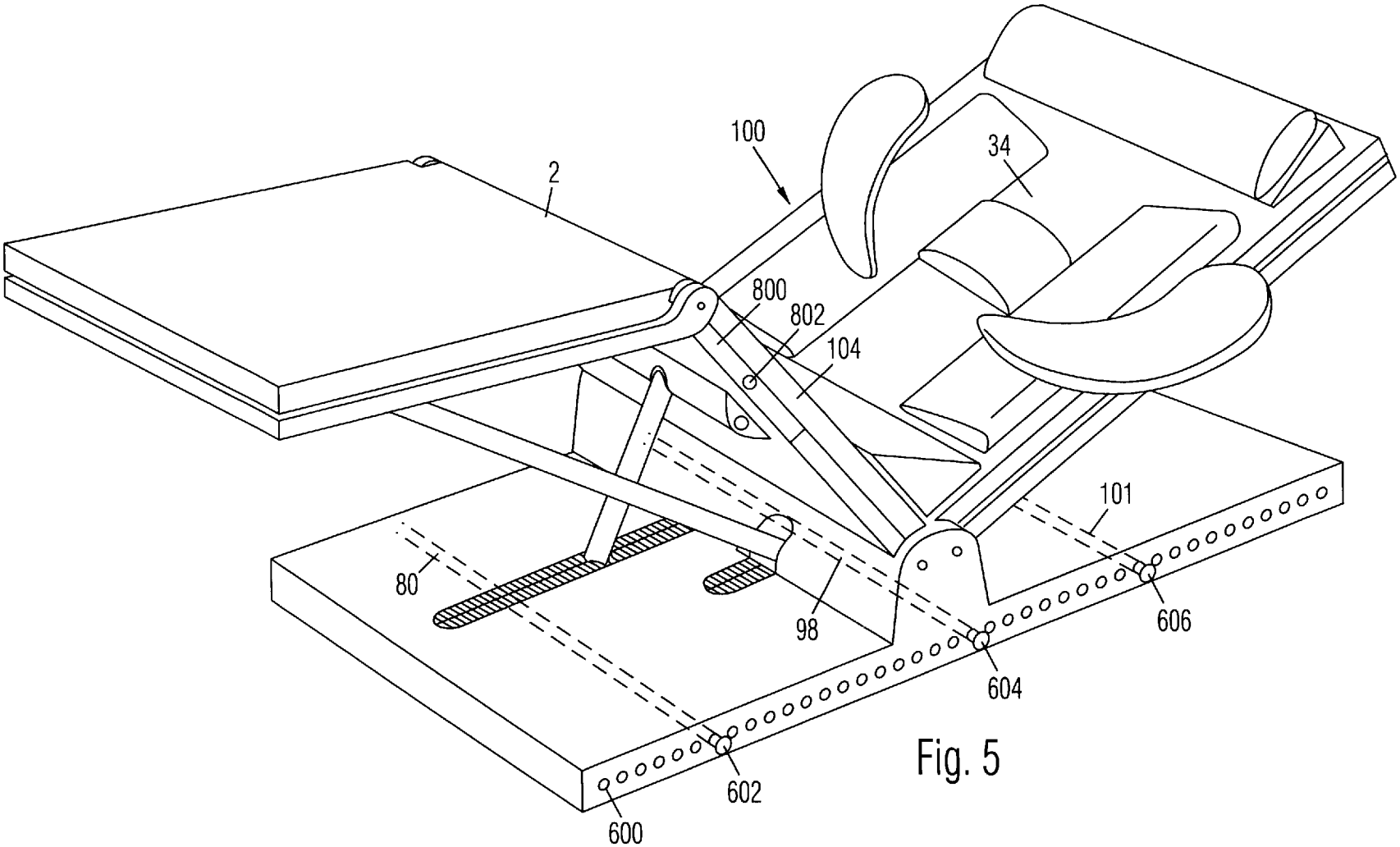
FIG. 5 is a perspective view of a manual version of the present invention.

FIG. 5 shows a perspective view of the lounge chair of the present invention 100 with a manually adjustable mechanism to change angles of support members 2, 104, 34. Instead of using motorized linear translators, the user plugs and unplugs locking pegs 602, 604, 606 into the desired holes 600. The locking pegs plug and unplug into the ends of horizontal push bars 80, 98, 101 thereby holding the support members 2, 104, 34 in the desired position. While this embodiment is less user friendly as far as angle adjustment, it is more economical and may be suitable for a user who has one favorite position and does not need to change angles frequently.

In this way, by use of the present invention, a person's body can be fully supported in a way that is most comfortable and beneficial in terms of ideal skeletal and muscular alignment and has been shown in tests to relieve back pain. Because of the three independent angularly adjustable support members, as well as the adjustable length thigh support, a person can adjust the chair to the ideal angle and size for his or her body. The additional adjustably removable and replaceable support cushions complete the system to provide the most comfortable lounge chair available in the world today.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A fully adjustable lounge chair comprising:

an independently adjustable back support member, thigh support member and foot support member;

a support pole for each said support member;

a horizontally disposed push bar centrally attached to each said support pole;

a rolling pinion gear rigidly attached to each end of a shaft supported by bearings within each said push bar so that said pinion gears reside at each end of said push bar;

a pair of horizontally disposed parallel rack type gears that mate with said rolling pinion gears;

three motorized screw type linear translation mechanisms respectively pivotally attached to said push bars;

U bracket type hinge members respectively connected between said support pole and the underside of each of the said back support, thigh support and foot support members;

a pair of second shafts and associated pivotal hinge points attaching said back and thigh support members to a pair of vertically disposed support plates;

a hinge point attaching the thigh support member to the foot support member;

a pair of cylindrical sockets located midway along the side rails of said back support, said sockets capable of pivotally holding arm support members.

2. A fully adjustable lounge chair as claimed in claim 1 further comprising a plurality of independent cushions including lumbar support, spine support, neck support, pelvic support and hip supports all capable of being removably attached and adjusted with respect to said back support member.

3. A fully adjustable lounge chair as claimed in claim 2 wherein said independent cushions are removably held in place to said back support member by flexible magnetic material hidden beneath upholstery of said cushions and said back support member.

4. A fully adjustable lounge chair as claimed in claim 1 wherein said linear translation mechanisms are horizontally disposed and hidden beneath a horizontal cover plate, said cover plate having slots to make way for said support poles, said slots having a brush member insert for covering said slots wherever said support pole is not located.

5. A fully adjustable lounge chair as claimed in claim 1 wherein said back, thigh and foot support members are controlled by a remote switch box which the user can operate while reclining.

6. A fully adjustable lounge chair as claimed in claim 1 wherein said arm supports can be angularly adjusted by means of a releasable and compressible pair of mating vertically disposed plates that rotate about a central point.

7. A fully adjustable lounge chair as claimed in claim 1 wherein said arm support members are segmented so that they can flex in an upward direction when necessary.

8. A fully adjustable lounge chair as claimed in claim 1 wherein instead of said motorized linear translation mechanisms to adjust the angles of said support members, a plurality of holes located in long sides of base channels allow locking pegs to penetrate the ends of said horizontal push bars thereby locking said push bars and associated said support members in a desired position.

9. A fully adjustable lounge chair as claimed in claim 1 wherein said thigh support member can be lengthened or shortened by means of a pair of extendable or retractable and lockable rigid slide members.

* * * * *